US006718959B2

(12) United States Patent
Kim

(10) Patent No.: US 6,718,959 B2
(45) Date of Patent: Apr. 13, 2004

(54) FUEL CONTROL METHOD FOR INTERNAL COMBUSTION ENGINE

(75) Inventor: Youn-Su Kim, Suwon (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/322,186

(22) Filed: Dec. 17, 2002

(65) Prior Publication Data

US 2003/0111068 A1 Jun. 19, 2003

(30) Foreign Application Priority Data

Dec. 18, 2001 (KR) ..... 2001-0080531

(51) Int. Cl.[7] ..... F02D 41/18
(52) U.S. Cl. ..... 123/692
(58) Field of Search ..... 123/673, 692

(56) References Cited

U.S. PATENT DOCUMENTS 4,130,095 A * 12/1978 Bowler et al. ..... 123/675
4,703,735 A * 11/1987 Minamitani et al. ..... 123/692
4,984,551 A * 1/1991 Moser ..... 123/692
5,341,788 A * 8/1994 Uchida ..... 123/692
5,749,221 A * 5/1998 Kawahira et al. ..... 123/692
6,050,250 A * 4/2000 Kerkau ..... 123/692
2002/0189602 A1 * 12/2002 Sugiyama et al. ..... 123/673

* cited by examiner

*Primary Examiner*—Erick Solis
(74) *Attorney, Agent, or Firm*—Morgan Lewis & Bockius LLP

(57) ABSTRACT

The invention provides a fuel control method and system for an internal combustion engine. The method includes: calculating an initial amount of fuel based on an amount of intake air, calculating a first cylinder bank air/fuel ratio matching coefficient and a second cylinder bank air/fuel ratio matching coefficient based on an engine speed and a volumetric efficiency, and controlling the amounts of fuel in the second and first banks, using the calculated second bank air/fuel ratio matching coefficient and the first bank air/fuel ratio matching coefficient, respectively. The system includes a control unit and a fuel injection system for implementing the method.

10 Claims, 4 Drawing Sheets

3000rpm, EV 15~80%

FUEL CONTROL METHOD FOR INTERNAL COMBUSTION ENGINE

FIELD OF THE INVENTION

The present invention relates to a fuel control method for a gasoline engine, and more particularly, to a fuel control method that employs air/fuel ratio matching coefficients to decrease the difference between the air/fuel ratios of a first cylinder bank and a second cylinder bank.

BACKGROUND OF THE INVENTION

There have been many attempts to increase engine output torque and decrease emission gases through engine fuel control. These have resulted in the development of an oxygen sensor for feedback control of the air/fuel ratio. To control the ratio, the oxygen sensor is disposed in the exhaust system of the engine. It detects the oxygen concentration in the exhaust gas. Signals from the oxygen sensor are used to maintain the air/fuel ratio near a stoichiometric value (14.7:1) through feedback control.

The air/fuel ratio is determined by engine operating conditions. For precise control of the air/fuel ratio, many control steps are needed for achieving and maintaining the stoichiometric value.

The air/fuel ratio is mainly determined by the amount of air and fuel. An initial amount of fuel is determined based on an amount of air drawn into the engine, as determined by a conventional mass air flow sensor. After setting the initial amount of fuel based on various operating conditions, such as different coolant temperatures, intake air temperatures, amounts of purge fuel, throttle openings, and engine speeds, etc., a final amount of fuel is determined. Also, the air/fuel ratio is modified through a feedback control loop than uses signals of the oxygen sensor to maintain the air/fuel ratio near the stoichiometric value.

This feedback control is performed under certain specific conditions. If the conditions control do not exist, the air/fuel ratio cannot be maintained to be near the stoichiometric value. And if the air/fuel ratio is far from the stoichiometric value, that is, if the air/fuel ratio is considerably lean or rich, noxious emission gases greatly increase.

To guard against increased emissions, the initial amount of fuel is modified using an air/fuel ratio matching coefficient. The air/fuel ratio matching coefficient is determined so that the air/fuel ratio is maintained to be near the stoichiometric value. That is, an amount of fuel is modified by multiplying the initial amount of fuel by the air/fuel ratio matching coefficient. The resultant air/fuel ratio using the modified amount of fuel is nearer the stoichiometric value.

The air/fuel ratio matching coefficient is preferably determined by engine speed and volumetric efficiency. The volumetric efficiency (%) is a ratio of an amount of air drawn into an engine with respect to a volume of a cylinder, under standard atmospheric pressure.

The air/fuel ratio matching coefficients for various combinations of engine speed and volumetric efficiency are experimentally determined and stored in a memory that is accessible by a controller. The controller applies the air/fuel ratio matching coefficient to the air/fuel ratio control for a particular engine speed. Thus, even when feedback control of the air/fuel cannot be performed, the air/fuel ratio may be maintained to be near the stoichiometric value.

In a V-6 engine having a first cylinder bank and a second cylinder bank, the air/fuel ratio matching coefficient is also used for the air/fuel ratio control. In conventional air/fuel ratio control, a common air/fuel ratio matching coefficient is applied to both banks, i.e., at a specific engine speed and volumetric efficiency, one air/fuel ratio matching coefficient is applied to both banks.

But, in an engine having a first bank and a second bank, amounts of air drawn into the first bank and the second bank are different because of the differences between the shapes of parts of the intake systems connected to the first and second banks. Therefore, if amounts of fuel are equal in both first and second banks, the air/fuel ratios of the first bank and the second bank are different, that is, the air/fuel ratio of one of the banks may be lean, while that of the other is rich.

SUMMARY OF THE INVENTION

In a preferred embodiment of the present invention, a fuel control method for an internal combustion engine comprises: detecting an amount of intake air; determining a basic (or initial) amount of fuel based on the detected amount of intake air; detecting an engine speed; calculating a volumetric efficiency based on the detected amount of intake air; determining a first cylinder bank air/fuel ratio matching coefficient and a second cylinder bank air/fuel ratio matching coefficient at the detected engine speed and the detected volumetric efficiency; and determining a final amount of fuel for the first bank based on the initial amount of fuel and the first bank air/fuel ratio matching coefficient; and determining a final amount of fuel for the second bank based on the initial amount of fuel and the second bank air/fuel ratio matching coefficient.

Preferably, the first bank air/fuel ratio matching coefficient and the second bank air/fuel ratio matching coefficient are determined such that both air/fuel ratios of the first bank and the second bank are maintained to be near a stoichiometric air/fuel ratio value at every engine speed and volumetric efficiency.

In a preferred embodiment of the present invention, the determining an amount of fuel comprises: determining that a current fuel control mode is not an air/fuel ratio feedback control mode; and determining an amount of fuel (TCONTROL) according to the following equation:

$$TCONTROL = TB \times (KLRN + KFB) \times \text{KMTCH_NEW} \times KWUP \times KAFND \times KPRGLEAN \times (1 + KAS) + \begin{bmatrix} T_{ACL} \\ 0 \\ T_{DCL} \end{bmatrix}$$

In an additional preferred embodiment of the invention the determination that the fuel control mode is not the air/fuel ratio feedback control mode is made based on a coolant temperature signal and an oxygen sensor signal.

In another preferred embodiment of the present invention, the fuel control system for an internal combustion engine including an first cylinder bank and a second cylinder bank comprises: a control unit for determining an amount of fuel based on one or more engine operating conditions and generating a signal representative of the determined amount of fuel; and a fuel injection device for injecting fuel into the engine according to the signal of the control unit. Preferably, the control unit is programmed to execute a control method comprising: detecting an amount of intake air; determining an initial amount of fuel based on an amount of intake air; detecting an engine speed; calculating a volumetric efficiency based on the detected amount of intake air and engine speed; determining a first bank air/fuel ratio matching coefficient and a second bank air/fuel ratio matching coefficient for the detected engine speed and the volumetric efficiency; determining a final amount of fuel for the first bank based on the initial amount of fuel and the first bank air/fuel ratio matching coefficient; and determining a final amount of fuel for the second bank based on the initial amount of fuel and the second bank air/fuel ratio matching coefficient.

Preferably, the first bank air/fuel ratio matching coefficient and the second bank air/fuel ratio matching coefficient are determined so that both air/fuel ratios of the first bank and the second bank are maintained to be substantially near a stoichiometric air/fuel ratio value at every engine speed and volumetric efficiency. This may be accomplished by modifying the initial amount of fuel with the first bank air/fuel ratio matching coefficient and the second bank air/fuel ratio matching coefficient.

BRIEF DESCRIPTION OF THE DRAWINGS

The following detailed description of the preferred embodiments of the present invention may be more fully understood with reference to the following drawings in which.

Like numerals refer to similar elements throughout the several drawings.

DETAILED DESCRIPTION OF THE PREFERRED EMBODIMENTS

Figure 1:
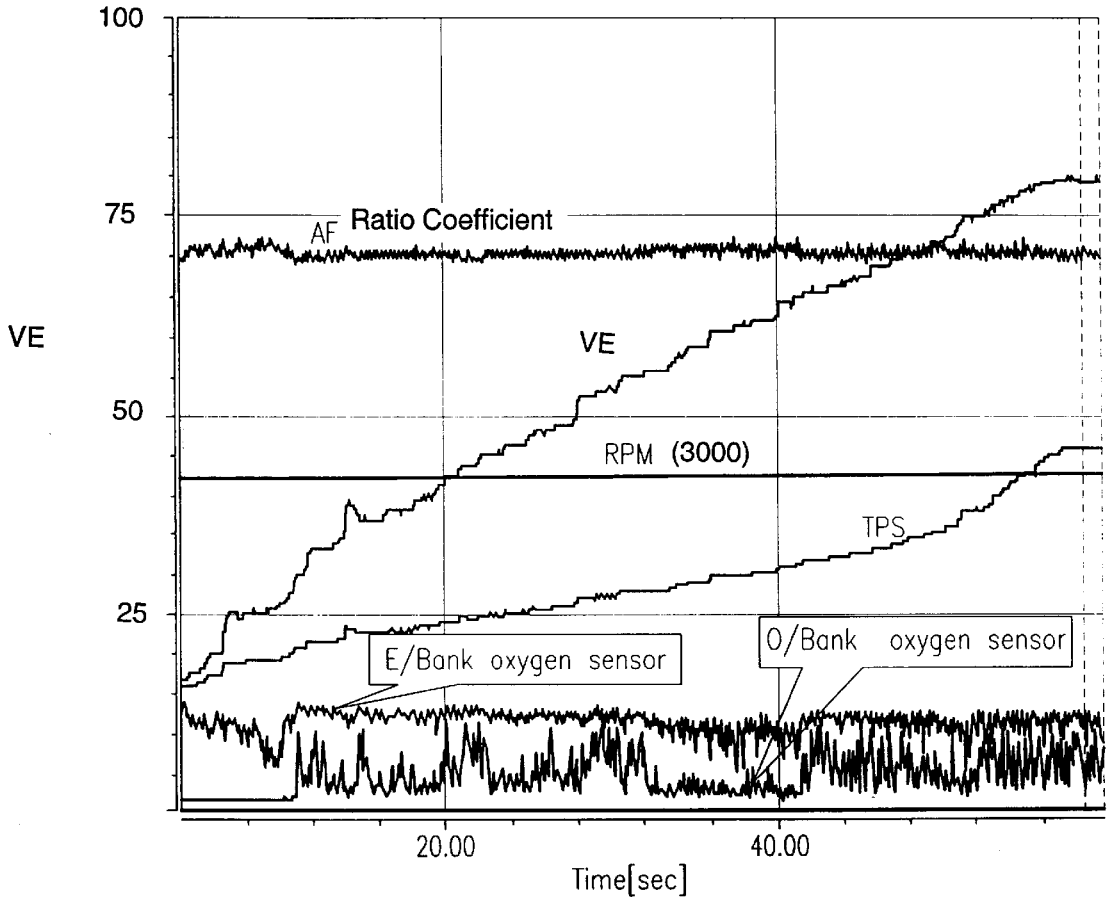
FIG. 1 is a graph showing differences between signals of a first cylinder bank oxygen sensor and a second cylinder bank oxygen sensor when both banks are controlled using a common air/fuel ratio matching coefficient.

FIG. 1 shows changes in the oxygen sensor signals that occur when applying a single air/fuel ratio matching coefficient to both banks of an engine, when the volumetric efficiency (VE) is varied from 15~80% at 3000 rpm. In this instance, the air/fuel ratio of the first bank (0/Bank) is rich and that of the second bank (E/Bank) is lean. With feedback control of the air/fuel ratio, feedback values for the first bank and the second bank are different because of the difference between the oxygen sensor signals of the first and second banks.

Figure 2:
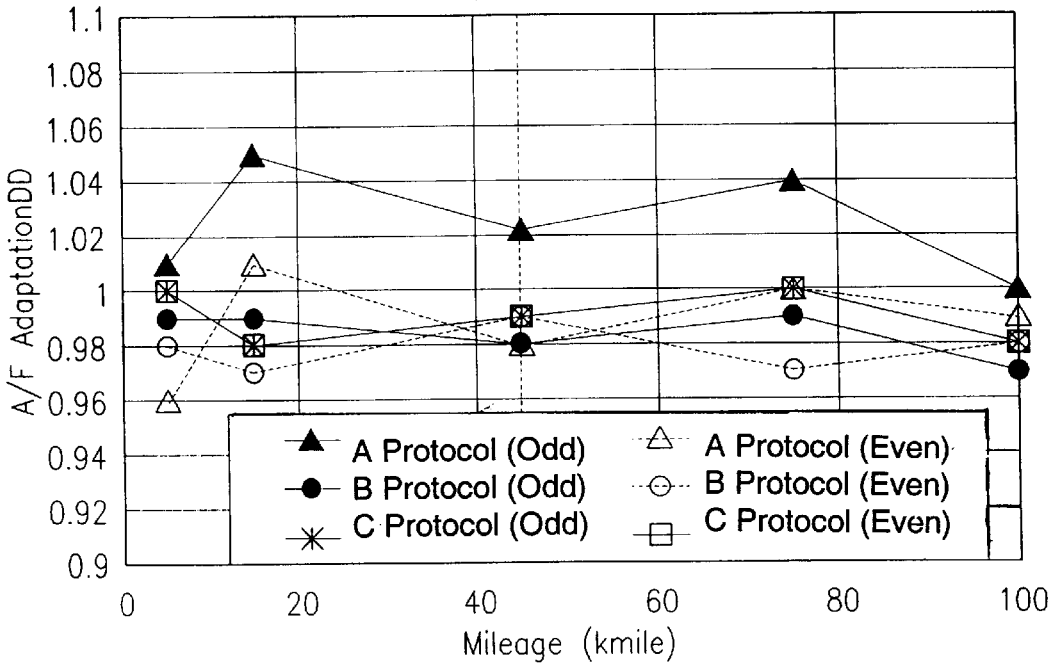
FIG. 2 is a graph showing air/fuel ratio feedback values during different protocols measured in a real vehicle.

FIG. 2 shows experimental results of feedback values (A/F) for both banks, during different testing protocols. The A protocol and B protocol of FIG. 2 are for a fuel mileage test protocol and an exhaust gas test protocol, respectively, where the air/fuel ratio feedback values are important. The C protocol is a high load protocol and the air/fuel ratio feedback value during this protocol is less important.

Using these A/F values for each bank during feedback control of the air/fuel ratio, the air/fuel ratios of both banks may be maintained near the stoichiometric value, though the air/fuel ratios of both banks tend to be substantially different from each other. Still, if the feedback control of the air/fuel ratio stops abruptly, the air/fuel ratio of one bank remains lean, and that of the other bank remains rich. Consequently, hydrocarbons (HC) and carbon monoxide (CO) increase in emission gases of the rich bank, and nitric oxide ($NO_x$) increases in emission gases of the lean bank.

Figure 4:
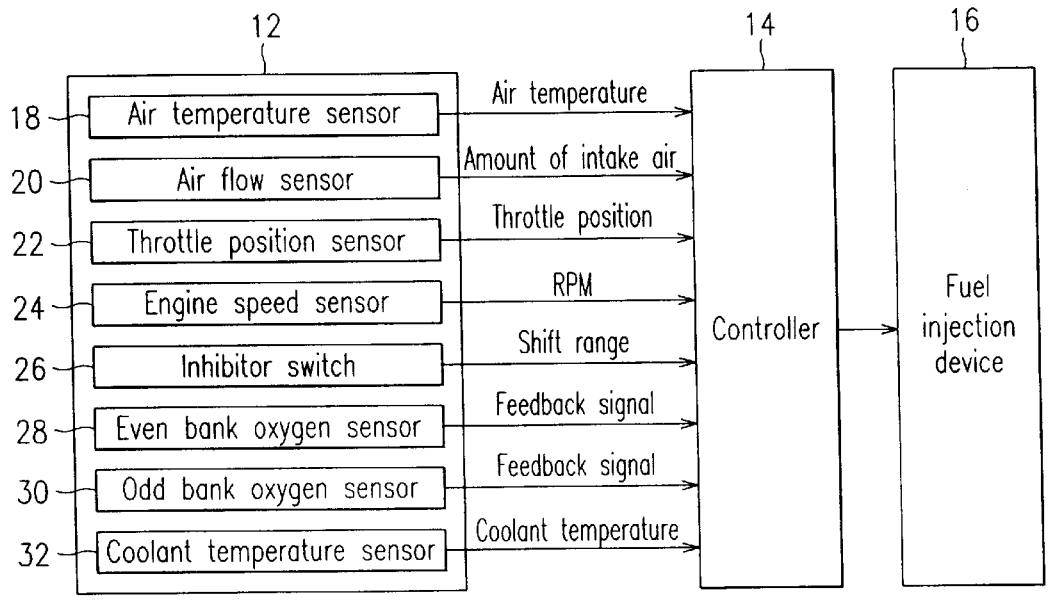
FIG. 4 is a schematic diagram of a fuel control system according to an embodiment of the present invention.

As shown in FIG. 4, a fuel control system, according to an embodiment of the present invention, for a V-type engine having first and second cylinder banks, includes a detection module 12 for detecting various engine operating conditions, a control unit 14, and a fuel injection device 16.

The detection module 12 includes: an air temperature sensor 18 for detecting a temperature of intake air; an air flow sensor 20 for detecting an amount of air drawn into an engine; a throttle position sensor 22 for detecting a throttle valve position; an engine speed sensor 24 for detecting an engine speed; an inhibitor switch 26 for detecting a current shift range; a first bank oxygen sensor 28 (Even bank) for detecting the oxygen concentration of oxygen in the exhaust from the first (even) cylinder bank; a second bank oxygen sensor 30 (Odd bank) for detecting the oxygen concentration in the exhaust from the second (odd) cylinder bank; and a coolant temperature sensor for detecting a temperature of engine coolant. Other suitable sensors may be devised by persons of ordinary skill in the art.

The control unit 14 preferably includes a processor, a memory, and other necessary hardware and software components, as will be understood by persons of ordinary skill in the art, to permit the control unit to communicate with sensors and execute the fuel injection control functions as described herein. The memory preferably includes a look-up table of the initial amounts of fuel that correspond to different amounts of intake air, and a look-up table of a first bank air/fuel ratio matching coefficient and a second bank air/fuel ratio matching coefficient that correspond to different engine speeds (rpm) and volumetric efficiencies. The detection member 12, the control unit 14, and the fuel injection device 16 communicate according to a conventional protocol known to one of ordinary skill in the art.

Figure 3:
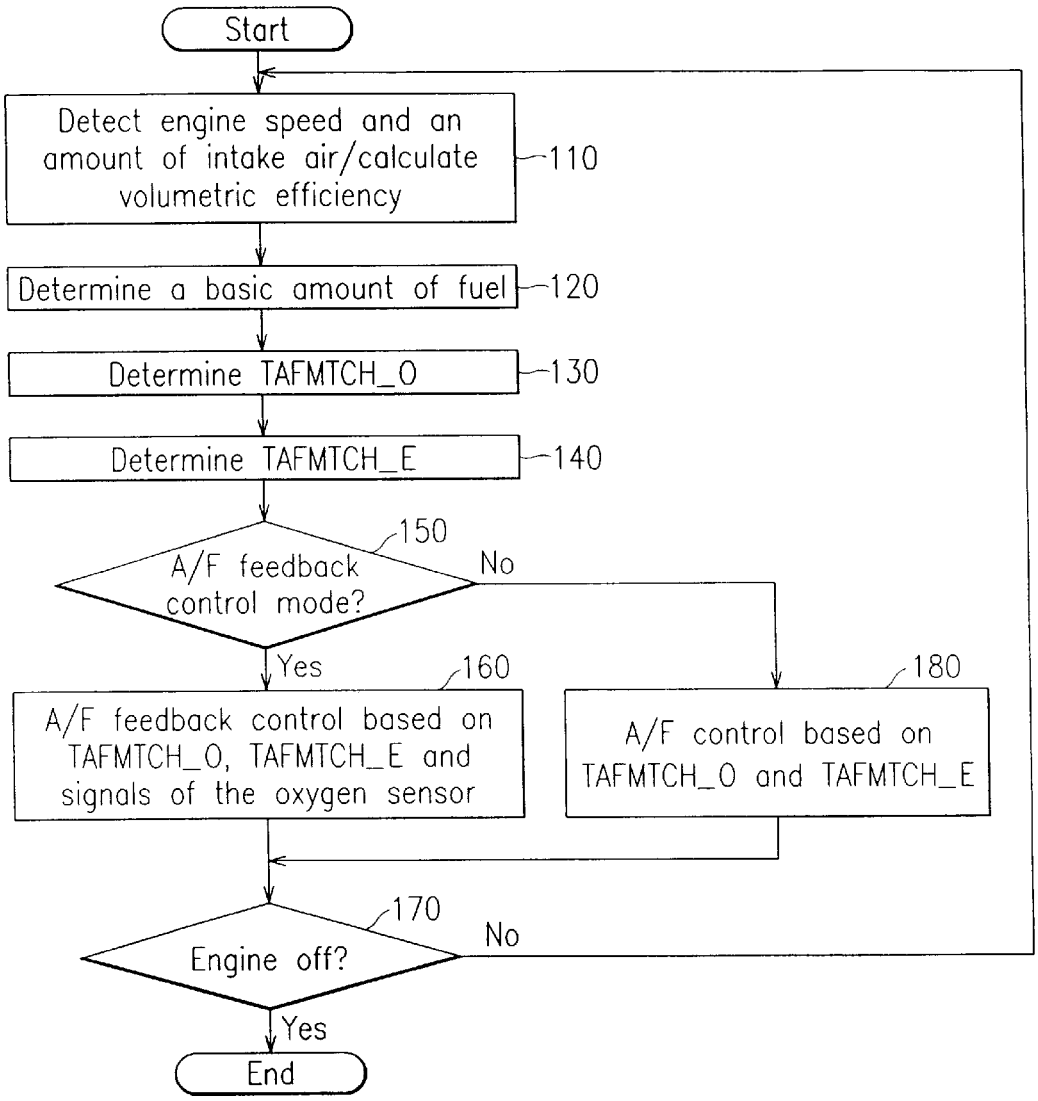
FIG. 3 is a flow chart showing a fuel control method according to a preferred embodiment of the present invention.

As shown in FIG. 3, in step 110 the method detects the engine speed (rpm) and an amount of intake air. The volumetric efficiency (%) is calculated based on the detected amount of intake air and rpm. An initial amount of fuel is determined in step 120. Preferably this initial amount of fuel is determined on the basis of the amount of intake air.

In steps 130 and 140 an air/fuel ratio matching coefficient ("KMTCH_NEW"), which is composed of a second bank air/fuel ratio matching coefficient TAFMTCH_O and a first bank air/fuel ratio matching coefficient TAFMTCH_E, is then calculated. The second bank air/fuel ratio matching coefficient TAFMTCH_O and the first bank air/fuel ratio matching coefficient TAFMTCH_E can be calculated at a specific engine speed (rpm) and a specific volumetric efficiency (%, or a ratio), but preferably they are obtained from a look-up table of engine speeds and volumetric efficiencies. KMTCH_NEW will be discussed in more detail regarding Equation 2 (below).

Next, in step 150 it is determined if the current fuel control mode is an air/fuel ratio feedback control mode. This determination is based on coolant temperature and oxygen sensor signals. For example, if the coolant temperature is higher than a predetermined value, and the oxygen sensor signals pass through a predetermined value (with these predetermined values being determined through experimentation), it is determined that the current fuel control mode is the feedback control mode. If the current fuel control mode is the feedback control mode, then in step 160 the amount of fuel is controlled according to a fuel control equation [modified Equation 1] using an oxygen sensor signal, and the second bank air/fuel ratio matching coefficient TAFMTCH_O, and the first bank air/fuel ratio matching coefficient TAFMTCH_E. Air/fuel ratio learning is also performed here. If the engine is stopped, the procedure is terminated in step 170. In step 160, the fuel control is performed according to Equation 1 (below), although the equation is modified to remove the catalyst protection air/fuel ratio enrichment coefficient KAF, KAFND, KPRGLEAN, KAS, $T_{ACL}$ and $T_{DCL}$.

If it is determined in step 150 that the present fuel control mode is not the air/fuel ratio feedback control mode, then in step 180 the amount of fuel is controlled using the second bank air/fuel ratio matching coefficient TAFMTCH_O and the first bank air/fuel ratio matching coefficient TAFMTCH_E, as well as other coefficients shown in Equation 1 (below).

$$TCONTROL = TB \times (KLRN + KFB) \times KAF \times \text{KMTCH_NEW} \times KWUP \times KAFND \times KPRGLEAN \times (1 + KAS) + \begin{bmatrix} T_{ACL} \\ 0 \\ T_{DCL} \end{bmatrix} \quad \text{[Equation 1]}$$

In Equation 1: TCONTROL is a final amount of fuel, TB is the initial amount of fuel, KLRN is an air/fuel ratio learning coefficient, KFB ($=1 \pm K_P + K_I$) is a fuel amount feedback coefficient ($K_P$ is a proportional coefficient and $K_I$ is an integral coefficient), KAF is a catalyst protection air/fuel ratio enrichment coefficient, KMTCH_NEW is the air/fuel ratio matching coefficient, KWUP is a hot air coefficient, KAFND is a low temperature N-R-D shift coefficient, KPRGLEAN is a lean air/fuel ratio coefficient during an initial intake of purge air, KAS is an air/fuel ratio coefficient after starting, and $T_{ACL}$ and $T_{DCL}$ are respectively an amount of fuel used if the vehicle is accelerating or decelerating (0 being used if the vehicle velocity is constant). These coefficients are adjusted and updated during vehicle operation.

Air/fuel ratio learning, which results in KLRN, the air/fuel ratio learning coefficient, is calculated based on the integral coefficient $K_I$. If $K_I > 1.0$, KLRN(n)=KLRN(n−1)+rich learning gain(%/25 msec). If $K_I = 1.0$, KLRN(n)=KLRN(n−1). And, if $K_I < 1.0$, KLRN(n)=KLRN(n−1)—lean learning gain (%/25 msec), where the learning gains are determined experimentally by one of ordinary skill in the art. The air/fuel ratio learning coefficient is renewed when the following conditions exist: 1) coolant temperature is greater than a reference coolant temperature; 2) intake air temperature is lower than a reference intake temperature; 3) the engine is operating in the air/fuel ratio feedback control mode; 4) the engine is not operating in a purge mode; 5) the coolant temperature sensor and intake air temperature sensor are operating normally; and 6) the atmospheric pressure is within a reference range.

The catalyst protection air/fuel ratio enrichment coefficient KAF is a factor for protecting the catalyst from damage by maintaining it at less than or equal to a predetermined temperature. The air/fuel ratio matching coefficient (KMTCH_NEW) is a factor for maintaining the air/fuel ratio near the stoichiometric value of 14.7 even when feedback control of the air/fuel ratio is not being performed (KMTCH_NEW is described in further detail below). The hot air coefficient (KWUP) is a factor for considering the effects of the temperature of the intake air on the air/fuel ratio. If the temperature of the intake air increases, the air density becomes lower so that the amount of intake air decreases substantially. Therefore, the hot air coefficient becomes smaller if the temperature of the intake air increases. The neutral-reverse-drive ("N-R-D") shift coefficient is a factor for compensating an abrupt decrease of engine speed during an N-R-D shift at a low coolant temperature. In general, values for the variables in Equation 1 are retrieved from look-up tables based on the vehicle operating conditions as measured by the various sensors, as is known to one of ordinary skill in the art.

In the fuel control method according to the present invention, to overcome the difference between the first bank and the second bank air/fuel ratios, the air/fuel ratio matching coefficient KMTCH_NEW has two values, one for the first bank and the other for the second bank. These drive the air/fuel ratios of the first and second banks toward the stoichiometric air/fuel ratio.

The air/fuel ratio matching coefficient is described in Equation 2.

$$\text{KMTCH_NEW} = \begin{bmatrix} \text{TAFMTCH_O}\{f(\text{rpm}, EV(\%)\} \\ \text{TAFMTCH_E}\{f(\text{rpm}, EV(\%)\} \end{bmatrix} \quad \text{[Equation 2]}$$

The air/fuel ratio matching coefficient KMTCH_NEW is map of data for controlling the amount of fuel in all operating ranges. This data map is determined experimentally, for a given engine for each bank of cylinders. Without feedback control of the air/fuel ratio, by modifying the basic (or initial) amount of fuel TB using the air/fuel ratio matching coefficient KMTCH_NEW, the air/fuel ratio can be controlled to be near the stoichiometric air/fuel ratio (lambda=1) in all operating ranges. Thus, even when feedback control of the air/fuel ratio cannot be performed, due to a malfunction of an oxygen sensor or other conditions, the air/fuel ratio can be maintained near the stoichiometric air/fuel ratio.

The final amount of fuel TCONTROL is determined by multiplying the basic fuel amount TB with the air/fuel ratio matching coefficient KMTCH_NEW, as shown in Equation 3.

[Equation 3]

$$TCONTROL = TB \times KMTCH_NEW$$

The method for determining the air/fuel ratio matching coefficient KMTCH_NEW experimentally does not involve the other coefficients. The values for KMTCH_NEW are determined as follows. A vehicle is mounted to a chassis dynamometer. The motor of the chassis dynamometer fixes the engine speed, and the volumetric efficiency is adjusted by a robot. The accelerator pedal is also operated by the robot. The robot is coupled to the throttle valve of the vehicle and controlled to regulate the duty cycle of the throttle valve, thus achieving a desired engine rpm and volumetric efficiency. The air/fuel ratio matching coefficient KMTCH_NEW is then determined for each cylinder bank so the air/fuel ratio is near the stoichiometric air/fuel ratio in each rpm grid (0~7000 rpm) when the TCONTROL amount of fuel is added.

As stated above, the fuel control method of the present invention can solve the problem of the difference in air/fuel ratio between the first bank and the second bank by respectively applying the air/fuel ratio matching coefficient KMTCH_NEW (TAFMTCH_O and TAFMTCH_E). Also, the air/fuel ratio learning values of both banks are similar to each other so that errors can be decreased. Furthermore, because independent air/fuel ratio matching coefficients TAFMTCH_O and TAFMTCH_E are applied to the first and second banks, the air/fuel ratios of both banks are close to stoichiometric even when the fuel control mode does not use feedback control. Therefore, if abruptly exiting the feedback control mode, the air/fuel ratios of both banks are maintained near the stoichiometric ratio, and emission of hydrocarbons, carbon monoxide, or nitric oxide, are prevented. Additionally, even more precise control of the air/fuel ratio control is obtained using the oxygen sensor signal.

Although preferred embodiments of the present invention have been described in detail above, it should be understood that the variations and/or modifications of the basic inventive concepts taught herein, which may appear to those of ordinary skill in the art, will still fall within the sprit and scope of the present invention, as defined in the appended claims.

What is claimed is:

1. A fuel control method for an internal combustion engine including a first cylinder bank and a second cylinder bank, comprising:

detecting an amount of intake air;

determining an initial amount of fuel based on the detected amount of intake air;

detecting an engine speed;

calculating a volumetric efficiency based on the detected amount of intake air and engine speed;

determining a first bank air/fuel ratio matching coefficient and a second bank air/fuel ratio matching coefficient for the detected engine speed and the calculated volumetric efficiency; and determining a final amount of fuel for the first bank based on the initial amount of fuel and the first bank air/fuel ratio matching coefficient; and determining a final amount of fuel for the second bank based on the initial amount of fuel and the second bank air/fuel ratio matching coefficient.

2. The method of claim 1, wherein the first bank air/fuel ratio matching coefficient and the second bank air/fuel ratio matching coefficient are determined so that both the air/fuel ratios of the first bank and the second bank are maintained to be near a stoichiometric air/fuel ratio value at every engine speed and volumetric efficiency.

3. The method of claim 1, wherein said determining a final amount of fuel comprises:

determining that a current fuel control mode is not an air/fuel ratio feedback control mode; and determining the final amounts of fuel (TCONTROL) for the first bank and the second bank according to the following equation:

$$TCONTROL = TB \times (KLRN + KFB) \times \text{KMTCH_NEW} \times KWUP \times KAFND \times KPRGLEAN \times (1 + KAS) + \begin{bmatrix} T_{ACL} \\ 0 \\ T_{DCL} \end{bmatrix}$$

4. The method of claim 3, wherein the determination of whether the fuel control mode is not the air/fuel ratio feedback control mode is made based on a coolant temperature and an oxygen sensor signal.

5. A fuel control system for an internal combustion engine including a first cylinder bank and a second cylinder bank, the system comprising:

a control unit for determining an amount of fuel based on one or more engine operating conditions and generating a signal representative of the determined amount of fuel; and a fuel injection device for injecting fuel into the engine according to the signal from the control unit, wherein the control unit is programmed to execute a control method comprising:

detecting an amount of intake air;

determining an initial amount of fuel based on the detected amount of intake air;

detecting an engine speed;

calculating a volumetric efficiency based on the detected amount of intake air and engine speed;

determining a first bank air/fuel ratio matching coefficient and a second bank air/fuel ratio matching coefficient for the detected engine speed and the volumetric efficiency;

determining a final amount of fuel for the first bank based on the initial amount of fuel and the first bank air/fuel ratio matching coefficient; and determining a final amount of fuel for the second bank based on the initial amount of fuel and the second bank air/fuel ratio matching coefficient.

6. The fuel control system of claim 5, wherein the first bank air/fuel ratio matching coefficient and the second bank air/fuel ratio matching coefficient are determined so that both the air/fuel ratios of the first bank and the second bank are maintained to be near a stoichiometric value at every engine speed and volumetric efficiency, by modifying the initial amount of fuel with the first bank air/fuel ratio matching coefficient and the second bank air/fuel ratio matching coefficient.

7. A fuel control method for an internal combustion engine including a first cylinder bank and a second cylinder bank, comprising:

determining an initial amount of fuel based on an amount of intake air;

determining a volumetric efficiency based on the amount of intake air and an engine speed;

determining a first bank air/fuel ratio matching coefficient and a second bank air/fuel ratio matching coefficient for the engine speed and the volumetric efficiency; and determining a final amount of fuel for the first bank based on the initial amount of fuel and the first bank air/fuel ratio matching coefficient; and determining a final amount of fuel for the second bank based on the initial amount of fuel and the second bank air/fuel ratio matching coefficient.

8. The method of claim 7, wherein said determining a final amount of fuel comprises:

determining that a current fuel control mode is not an air/fuel ratio feedback control mode; and determining a final amount of fuel (TCONTROL) according to the following equation:

$$TCONTROL = TB \times (KLRN + KFB) \times \text{KMTCH_NEW} \times KWUP \times KAFND \times KPRGLEAN \times (1 + KAS) + \begin{bmatrix} T_{ACL} \\ 0 \\ T_{DCL} \end{bmatrix}$$

9. The method of claim 8, wherein the determination of whether the fuel control mode is not the air/fuel ratio feedback control mode is made based on a coolant temperature and an oxygen sensor signal.

10. The method of claim 7, wherein said determining a final amount of fuel comprises:

determining that a current fuel control mode is an air/fuel ratio feedback control mode; and determining a final amount of fuel (TCONTROL) according to the following equation:

$$TCONTROL = TB \times (KLRN + KFB) \times KMTCH_NEW \times KWUP.$$

* * * * *